United States Patent [19]

Scheel

[11] 4,145,910

[45] Mar. 27, 1979

[54] DIE AND METHOD OF MAKING THE SAME

[75] Inventor: Frank R. Scheel, Fridley, Minn.

[73] Assignee: Carmet Company, Pittsburgh, Pa.

[21] Appl. No.: 808,220

[22] Filed: Jun. 20, 1977

[51] Int. Cl.[2] ..... B21C 3/04

[52] U.S. Cl. ..... 72/467

[58] Field of Search ..... 72/467, 352, 349; 76/107 A

[56] References Cited

U.S. PATENT DOCUMENTS

| | | | |
|---|---|---|---|
| 2,602,539 | 7/1952 | See | 74/467 X |
| 3,178,925 | 4/1965 | Nolan et al. | 72/467 X |
| 3,918,288 | 11/1975 | Verduzco et al. | 72/467 |

*Primary Examiner*—Milton S. Mehr

*Attorney, Agent, or Firm*—Vincent G. Gioia; Robert F. Dropkin

[57] ABSTRACT

A reusable draw or ironing die includes a tool steel body having an axial hole therethrough. A first carbide insert is shrunk fit into the axial hole and a second carbide insert is press fit within the first carbide insert.

7 Claims, 2 Drawing Figures

DIE AND METHOD OF MAKING THE SAME

This invention relates to a die assembly and particularly to a reusable draw or ironing die assembly used in the manufacture of cans. It may also be used in other types of dies including heading and extrusion dies for use with various types of material in addition to steel can bodies. The dies currently in use have a precision ground steel body with a counterbored axial hole therethrough. The working surface of the die is provided by a carbide insert which is shrunk fit into the counterbore. In making the shrink fit the die body becomes deformed to such an extent that it is more expensive to repair the body and replace it with a new insert when the old one must be replaced than to make a new die body and put in a new insert. Thus no part of the die is reused. In some instances it is desirable to use a die made of a harder material than the carbide, such as synthetic sapphires or diamonds, but this cannot be done with the present structure.

I have found that by using two carbide inserts, one within the other with the outer insert shrunk fit into the die body and the inner insert press fit into the outer insert, it is possible to replace the old worn out inner insert with a new inner insert, thus greatly reducing the die cost. In addition, the die is stronger so that it does not break as easily. It also permits making the inner insert of materials harder than the carbides presently used.

It is therefore an object of my invention to provide a die assembly which permits reuse of the die body while replacing only the carbide insert having the working surface thereon.

Another object is to provide such a die assembly which reduces the overall die cost.

A further object is to provide such a die assembly which is stronger than previous dies and which enables use of harder materials.

Figure 1:
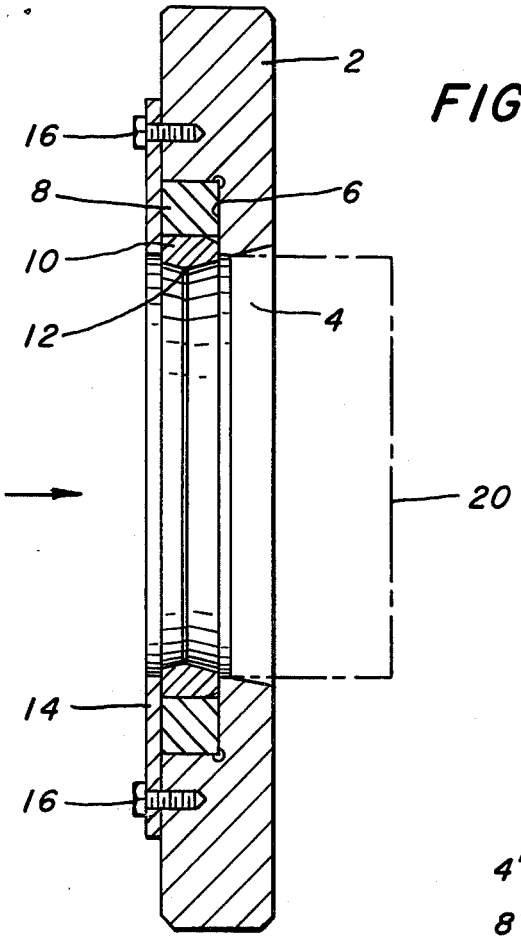
Figure 2:
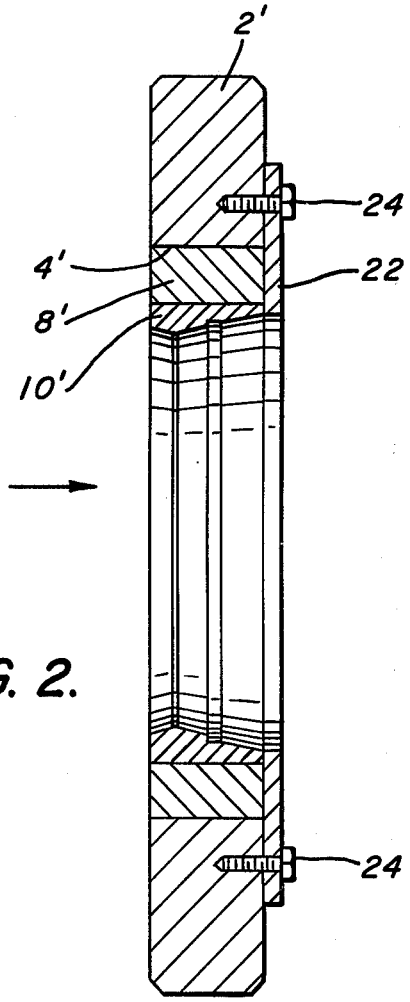

These and other objects will be more apparent after referring to the following specification and attached drawings in which FIG. 1 is a sectional view of a die of my invention; and FIG. 2 is a sectional view of a second species of my invention.

Referring more particularly to FIG. 1 of the drawings, reference numeral 2 indicates the die body or housing of my invention. The die body is conventionally made of tool steel and has a counterbored axial hole 4 therethrough. It will be seen that the bottom of the counterbore forms a shoulder 6. A first carbide insert or ring 8 is received in the counterbore against the shoulder 6. It will be seen that the inner diameter of insert 8 is greater than the inner diameter of the counterbore. A second carbide insert or ring 10 is received within the first carbide insert 8 against the shoulder 6. The inner surface 12 of insert 10 extends beyond the shoulder 6 and forms the die working surface. If desired, a plate retainer 14 may be detachably secured to the entry side of die body 2 against insert 10 by means of bolts 16 to insure that the insert remains in place. While the inserts may be made of the same material it is possible and generally advisable to make the insert 8 of cheaper and softer material than insert 10. The type of material may vary depending upon the material being worked, but tungsten carbides of various grades have been successful in use. The outer diameter of the insert 10 is only slightly greater than the inner diameter of insert 8. The body 2 has a higher yield strength and is softer than insert 8 while insert 10 usually has a lower strength and usually is harder than insert 8. The hardness of the insert 10 usually ranges from 25 Rockwell C to diamond.

In making the die, the insert 8 is shrunk fit into the body 2 in the usual manner. This provides ring strength for the insert 10. While the die body 2 is deformed the insert 8, particularly its inner diameter surface is not deformed. The insert 10 is then press fitted into the insert 8. Since the press fit is less severe than the shrunk fit, it will not cause any substantial deformation. However, it is necessary to have the first insert shrunk fit to provide the necessary ring or "hoop" strength. When the inner insert becomes so worn that it must be replaced it may be removed in any suitable manner such as by pressing a removing plug 20 against the exit side of the insert. A new insert is then pressed into place. This manner of construction prestresses the body, thus building up its strength.

I have found that the die is substantially stronger than the conventional die regardless of whether or not the inserts 8 and 10 are of the same material or not. However, by making the insert 8 of cheaper and softer material greater strength is obtained than when using the same material in both inserts. For that reason it is highly desirable to use the softer inner insert for drawing dies.

The species of my invention shown in FIG. 2 is essentially the same as that of FIG. 1 except that the body 2', instead of having a counterbored axial hole, has a straight hole 4' therethrough with the inserts 8' and 10' extending the full length of the hole. A plate 22 is secured to the exit side of the body 2' by means of cap screws 24 to insure that the inserts 8' and 10' will not move axially. This plate 22 takes the place of the shoulder 6 of FIG. 1.

While two embodiments have been shown and described in detail, it will be readily apparent to those skilled in the art that various adaptations and modifications may be made within the scope of the invention.

I claim:

1. A die assembly comprising a steel housing having an axial hole therethrough, a first insert made of a carbide positioned permanently in said axial hole and having a shrink fit with said body resulting in a highly stressed condition in said housing, and a second insert within said first insert and having a press fit therewith, said second die having a die working surface, and said inserts having far greater hardness than said body, said second insert having a hardness at least as great as the first insert, whereby when said second insert becomes worn and is replaced said housing and first insert assembly remain in condition suitable for reuse.

2. A die assembly according to claim 1 in which said second insert is made of a more expensive and harder carbide than said first insert.

3. A die assembly according to claim 1 including a retainer detachably secured to the entry end of said body and bearing against said inserts, said retainer having an inner diameter greater than that of said second insert.

4. A die assembly according to claim 3 in which said second insert is made of a more expensive and harder carbide than said first insert.

5. A die assembly according to claim 1 including a radial shoulder against which the exit end of said inserts bear.

6. A die assembly according to claim 5 in which said radial shoulder is provided by means of a counterbore on the entry side of said axial hole.

7. A die assembly according to claim 6 in which said second insert is made of a more expensive and harder carbide than said first insert.

* * * * *